US007335285B2

(12) United States Patent
Furuta et al.

(10) Patent No.: US 7,335,285 B2
(45) **Date of Patent: *Feb. 26, 2008**

(54) ELECTROLYTIC ANODE AND METHOD FOR ELECTROLYTICALLY SYNTHESIZING FLUORINE CONTAINING SUBSTANCE USING THE ELECTROLYTIC ANODE

(75) Inventors: Tsuneto Furuta, Fujisawa (JP); Masaharu Uno, Fujisawa (JP); Yoshinori Nishiki, Fujisawa (JP); Tetsuro Tojo, Osaka (JP); Hitoshi Takebayashi, Osaka (JP); Masashi Kodama, Osaka (JP)

(73) Assignees: Permelec Electrode Ltd., Kanagawa (JP); Toyo Tanso Co., Ltd., Osaka (JP)

( * ) Notice: Subject to any disclaimer, the term of this patent is extended or adjusted under 35 U.S.C. 154(b) by 31 days.

This patent is subject to a terminal disclaimer.

(21) Appl. No.: 11/374,080

(22) Filed: Mar. 14, 2006

(65) Prior Publication Data

US 2006/0219570 A1 Oct. 5, 2006

(30) Foreign Application Priority Data

Mar. 14, 2005 (JP) ..... P.2005-071489

(51) Int. Cl.
*C25B 11/12* (2006.01)

(52) U.S. Cl. ..... 204/294; 204/290.01; 204/290.15

(58) Field of Classification Search ..... 204/294, 204/290.01, 290.15
See application file for complete search history.

(56) References Cited

U.S. PATENT DOCUMENTS

2003/0064225 A1* 4/2003 Ohashi et al. ..... 428/408

* cited by examiner

*Primary Examiner*—Bruce F. Bell
(74) *Attorney, Agent, or Firm*—Sughrue Mion, PLLC

(57) ABSTRACT

The present invention provides an electrolytic anode for use in electrolytically synthesizing a fluorine-containing substance by using an electrolytic bath containing a fluoride ion including: an electroconductive substrate having a sure including an electroconductive carbonaceous material; and an electroconductive carbonaceous film having a diamond structure, the electroconductive carbonaceous film coating a part of the electroconductive carbonaceous substrate, and a method for electrolytically synthesizing a fluorine-containing substance using the electrolytic anode.

6 Claims, No Drawings

ELECTROLYTIC ANODE AND METHOD FOR ELECTROLYTICALLY SYNTHESIZING FLUORINE CONTAINING SUBSTANCE USING THE ELECTROLYTIC ANODE

FIELD OF THE INVENTION

This invention relates to an electrolytic anode to be used for electrolysis using an electrolytic bath containing a fluoride ion and, particularly, to an electrolytic anode which is suppressed in exhibition of an anode effect even when it is operated under a high current density, is free from generation of sludge due to electrode dissolution, and has a diamond structure enabling a reduction in generation of a carbon tetrafluoride gas and continuous stable electrolysis as well as to electrolytic synthesis of a fluorine-containing substance using such electrolytic anode.

BACKGROUND OF THE INVENTION

Fluorine and its compounds have widely been used for atomic power industry, medical products, household articles, and so forth due to its unique characteristics. Since a fluorine gas ($F_2$ gas) is chemically stable and cannot be isolated by methods other than electrolysis, the fluorine gas is produced by electrolysis using an electrolytic bath containing a fluoride ion. Also, a several useful fluorine compounds are produced by electrolytic synthesis using the electrolytic bath containing fluoride ion. Among others, a nitrogen trifluoride gas ($NF_3$ gas) has recently been increased in production amount like the fluorine gas.

Industrial-scale mass production of the $F_2$ gas has been conducted so as to use the $F_2$ gas as a raw material for synthesis of uranium hexafluoride ($UF_6$) for uranium concentration and sulfur hexafluoride ($SF_6$) for a high dielectric gas. In semiconductor industries, since the $F_2$ gas reacts with a silicon oxide film or selectively reacts with an impure metal, the $F_2$ gas is used for dry cleaning of silicon wafer surfaces. Also, as general industrial usages, the $F_2$ gas is being used on industrial-scale as a fluorine processing raw material for suppressing a gas permeability of a high density polyethylene used for a gasoline tank or a fluorine processing raw material for improving wettability of an olefin-based polymer. When the olefin-based polymer is processed with a mixture gas of fluorine and oxygen, a carbonyl fluoride group (—COF) is introduced into a surface of the olefin-based polymer. The carbonyl fluoride group easily changes to a carboxyl group (—COOH) by hydrolysis such as a reaction with humidity in the air to improve the wettability.

The $F_2$ gas was isolated by Moissan in 1886 for the first time, and then Argo et al. succeeded in synthesizing the $F_2$ gas by electrolyzing a mixed molten salt of potassium fluoride and hydrogen fluoride in 1919, whereby the $F_2$ gas synthesis industry was established. In the initial stage, a carbonaceous material such as graphite or nickel was used for an anode. Though nickel is usable also in an electrolytic bath containing water, it is rapid in corrosion and dissolution, has a current efficiency of about 70%, and is subject to a large amount of fluoride sludge. Therefore, a method that is employed most frequently at present is a method established in 1940s, wherein a carbon electrode is used as an anode and KF-2HF molten salt having a KF:HF molar ratio of 1:2 is used as an electrolytic bath. However, this method still has many problems in operation.

In the case of using the carbon electrode in the electrolytic bath containing a fluoride ion, such as the KF-2HF molten salt, a fluorine generation reaction represented by Formula (1) due to discharge of an fluoride ion occurs on a surface of the electrode, and, at the same time, graphite fluoride $(CF)_n$ having a C—F bonding of a covalent bonding property represented by Formula (2) is generated to cover the electrode surface. Since $(CF)_n$ is considerably low in surface energy, wettability thereof with the electrolytic bath is poor. Though $(CF)_n$ is thermally decomposed into carbon tetrafluoride ($CF_4$) or ethane hexafluoride ($C_2F_6$) as represented by Formula (3) due to Joule heat, the carbon electrode surface is covered with $(CF)_n$ when a speed of Formula (2) exceeds that of Formula (3) to reduce an area for the electrode to contact an electrolytic solution, thereby ultimately stops a flow of a current. That is, a so-called anode effect is exhibited ultimately. When a current density is high, the speed of Formula (2) is increased to easily cause the anode effect.

$$HF_2^- \rightarrow \tfrac{1}{2}F_2 + HF + e^- \quad (1)$$

$$nC + nHF_2^- \rightarrow (CF)_n + nHF + e^- \quad (2)$$

$$(CF)_n \rightarrow xC + yCF_4, zC_2F_6, \text{ etc.} \quad (3)$$

The anode effect tends to occur when a water content in the electrolytic bath is high. As shown in Formula (4), carbon on the electrode surface reacts with water in the electrolytic bath to generate graphite oxide $[C_xO(OH)_y]$. Since $C_xO(OH)_y$ is unstable, it reacts with atomic fluorine generated due to the discharge of fluoride ion as represented by Formula (5) to change into $(CF)_n$. Further, due to the generation of $C_xO(OH)_y$, an interlayer gap of graphite is widened to facilitate diffusion of fluorine, thereby increasing the generation speed of $(CF)_n$ represented by Formula (2). Thus, it is apparent that the anode effect occurs easily in the case where a water content in a mixed molten salt bath containing the fluoride ion is high.

$$xC + (y+1)H_2O \rightarrow C_xO(OH)_y + (y+2)H^+ + (y+2)e^- \quad (4)$$

$$C_xO(OH)_y + (x+3y+2)F^- \rightarrow x/n(CF)_n + (y+1)OF_2 + yHF + (x+3y+2)e^- \quad (5)$$

The anode effect is a big problem in using the carbon electrode since the occurrence of the anode effect remarkably reduces a production efficiency, and an explosion can be caused in some cases if a power supply was not stopped immediately after the occurrence of the anode effect. Therefore, operation is complicated by the anode effect since it is necessary to perform water content control in the electrolytic bath employing dehydration electrolysis, and it is necessary to maintain a current density lower than a critical current density with which the anode effect occurs. The critical current density of generally used carbon electrodes is less than 10 $A/dm^2$. Though it is possible to raise the critical current density by adding 1 to 5 wt % of a fluoride such as lithium fluoride and aluminum fluoride to the electrolytic bath, the critical current density can only be raised to about 20 $A/dm^2$.

An $NF_3$ gas was synthesized for the first time in 1928 by Ruff et al. by using a molten salt electrolysis and consumed by a large scale as a fuel oxidizing agent for a planetary exploration rocket planed and produced by NASA of U.S.A. to draw much attention. At present, the $NF_3$ gas is used on a large scale as a dry etching gas in a semiconductor manufacturing process and a cleaning gas for a CVD chamber in a semiconductor or liquid crystal display manufacturing process. In recent years, since it has been clarified that a PFC (Perfluorinated Compound) such as carbon tetrafluoride ($CF_4$) and ethane hexafluoride ($C_2F_6$) used for a cleaning gas for CVD chamber influences greatly on the global warming, the use of PFC is being restricted or prohibited internationally by the Kyoto Protocol, and the $NF_3$ gas is used on a larger scale as a substitute for the PFC.

At present, $NF_3$ is manufactured by two types of methods, i.e. by a chemical method and molten salt electrolysis. In the chemical method, $F_2$ is obtained by electrolyzing the KF-2HF mixed molten salt, and then $NF_3$ is obtained by reacting $F_2$ with a metallic fluoride ammonium complex or the like. In the molten salt electrolysis, a molten salt of ammonium fluoride ($NH_4F$) and HF or a mixed molten salt of $NH_4F$, KF, and HF is electrolyzed to directly obtain $NF_3$. In the case of using the mixed molten salt of $NH_4F$, KF and HF, the $NH_4F$—KF—HF molten salt of a molar ratio of 1:1:(2 to 5), respectively, is ordinary electrolyzed by using a carbon electrode as an anode. In this method, in the same manner as in the case of obtaining $F_2$ by electrolyzing the KF-2HF molten salt, it is necessary to perform the complicated water content control in the electrolytic bath for the purpose of preventing the occurrence of the anode effect, and it is necessary to operate under the critical current density. Further, there has been a problem that $CF_4$ and $C_2F_6$ generated by Formula (3) reduce a purity of the $NF_3$ gas. Since properties of $CF_4$ and properties of $C_2F_6$ or $NF_3$ are remarkably close to each other, it is difficult to separate them by distillation, Therefore, there is another problem that, for the purpose of obtaining high purity $NF_3$, it is inevitable to employ a purification method which is a cause of an increase in cost.

In the case of obtaining $NF_3$ by using the $NH_4F$—HF mixed molten salt, the $NH_4F$—HF mixed molten salt having a molar ratio of 1:(1 to 3) is ordinarily electrolyzed by using nickel as an anode. In this method, it is possible to perform electrolysis using the electrolytic bath containing moisture as in the same manner as in obtaining the $F_2$ gas by using the KF—HF mixed molten salt, and the method has an advantage of synthesizing $NF_3$ which is not contaminated by $CF_4$ and $C_2F_6$. However, since nickel is dissolved into an electrolytic solution to accumulate at the bottom of the electrolytic cell as a nickel fluoride sludge, it is necessary to change the electrolytic bath and the electrode at a constant interval, and it is difficult to produce $NF_3$ continuously. An amount of dissolution of nickel reaches to 3 to 5% of a power supply. Since the nickel dissolution amount is remarkably increased when the current density is increased, it is difficult to perform electrolysis at a high current density.

As described in foregoing, there has been a strong demand for an anode material having properties of reduced in anode effect, sludge, and generation of $CF_4$ in the electrolysis using an electrolytic bath containing a fluoride ion in order to continuously conduct a stable production.

Fluoride metallic gases are necessary for formation of a thin film, a dopant for ion implantation, and lithography in the semiconductor and liquid crystal display manufacturing processes, and many of the fluoride metallic gases are synthesized by using the $F_2$ gas as a starting material. Therefore, the anode material having the above-described properties is in demand also for producing the fluoride metallic gases.

[Reference 1] JP-A-7-299467
[Reference 2] JP-A-2000-226682
[Reference 3] JP-A-11-269685
[Reference 4] JP-A-2001-192874
[Reference 5] JP-B-2004-195346
[Reference 6] JP-A-2000-204492
[Reference 7] Carbon; vol, 38, page 241 (2000)
[Reference 8] Journal of Fluorine Chemistry, vol. 97, page 253 (1999)

Among the above described carbon electrodes, the so-called electroconductive diamond electrode using electroconductive diamond as an electrode catalysis has been adapted to various electrolysis processes. Reference 1 proposes a processing method wherein an organic substance in a waste liquid is decomposed by oxidization using the electroconductive diamond electrode. Reference 2 proposes a method of chemically processing an organic substance by using the electroconductive diamond electrode as an anode and a cathode. Reference 3 proposes an ozone synthesis method using the electroconductive diamond electrode as an anode. Reference 4 proposes peroxosulfuric acid synthesis using the electroconductive diamond electrode as an anode. Reference 5 proposes a method of disinfecting microbes using the electroconductive diamond electrode as an anode.

In all of the above literatures, the electroconductive diamond electrode is applied to solution electrolysis containing no fluoride ion, and these inventions do not consider the electrolytic bath containing a fluoride ion.

Though Reference 6 discloses a method of using a semiconductor diamond in a bath containing fluoride ion, the invention relates to an organic electrolytic fluorination reaction by way of a fluorine substitution reaction caused after the dehydration reaction in a potential region lower than a potential at which the discharge reaction of fluoride ion represented by Formulas (1) and (2) occurs, i.e. in a region free tom a fluorine generation reaction, and it is impossible to apply the method to the productions of the fluorine gas and $NF_3$. Therefore, when the electrode according to Reference 6 is used in the region of occurrence of the discharge reaction of fluoride ion, which inhibits stability of existent carbon electrodes and nickel electrodes and is represented by Formula (1), problems such as discontinuation of the electrolysis due to decay of the electrodes are caused.

SUMMARY OF THE INVENTION

An object of the present invention is to provide an electrolytic anode which solves the above problems and is suppressed in generation of anode effect, free from generation of sludge due to electrode dissolution, reduced in generation of a $CF_4$ gas, and capable of continuing stable synthesis of a fluorine-containing substance even when the anode is operated under a high current density, and a method for electrolytic synthesis using the anode.

This invention provides an electrolytic anode to be used for electrolytic synthesis of a fluorine-containing substance by using an electrolytic bath containing a fluoride ion. The invention provides an electrolytic anode for use in electrolytically synthesizing a fluorine-containing substance by using an electrolytic bath containing a fluoride ion comprising; an electroconductive substrate having a surface including an electroconductive carbonaceous material; and an electroconductive carbonaceous film having a diamond structure, the electroconductive carbonaceous film coating a part of the electroconductive carbonaceous substrate, and a method for electrolytically synthesizing a fluorine-containing substance, comprising: preparing an electrolytic anode comprising: an electroconductive substrate having a surface including an electroconductive carbonaceous material; and an electroconductive carbonaceous film having a diamond structure, the electroconductive carbonaceous film coating a part of the electroconductive carbonaceous substrate; and performing electrolysis by using the electrolytic anode in an electrolytic bath containing a fluoride ion to obtain a fluorine-containing substance.

DETAILED DESCRIPTION OF THE INVENTION

Hereinafter, this invention will be described in detail.

The inventors have conducted extensive researches to find that an electrode having: an electroconductive substrate of which at least a surface is made from a carbonaceous material; and an electroconductive carbonaceous film having a diamond structure and coating at least a part of the electroconductive substrate is usable for electrolysis in an electrolytic bath containing a fluoride ion and enables electrolytic synthesis of a fluorine-containing substance.

Examples of the electroconductive carbonaceous film having the diamond structure include electroconductive diamond and electroconductive diamond-like carbon, which are thermally and chemically stable materials.

More specifically, the inventors have found that, wettability of the electrolytic solution with the electrode is not reduced, the anode effect does not occur, generation of sludge due to electrode dissolution is suppressed, and $CF_4$ generation is remarkably reduced when the anode is operated at a high current density not less than 20 $A/dm^2$ without adding lithium fluoride or aluminum fluoride in the case of performing electrolysis of a KF-2HF molten salt, a $NH_4F$-(1 to 3)HF molten salt, or a $NH_4F$—KF—HF molten salt by using the anode. The reason for such effects is that, $(CF)_n$ which is poor in wettability with the electrolytic bath is formed on a carbonaceous part of an electrode that does not have the electroconductive carbonaceous film having a diamond structure and that is exposed to the electrolytic bath to protect stability of the carbonaceous part along with a progress of electrolysis, on the other hand, the reaction continues on the diamond structure since the diamond structure is stable. Though the cause of the stability of the diamond structure in these systems has not been clarified, it is inferable that the chemically stable diamond structure does not change except for fluorine termination of an outermost surface of a diamond layer, and that the anode effect, the $CF_4$ generation, and the electrode dissolution are suppressed because generation of a C—F covalent bonding compound is not progressed. It is also inferable that the diamond structure is maintained even when the high current density is applied since the diamond structure is stable.

It has been reported by Touhara et al. in Reference 7 that bands belonging to stretching of C—H and a stretching of C═O are lost; band belonging to a stretching of C—F appear, and a bulk diamond structure is not changed after a thermal fluorine treatment of diamond subjected to hydrogen termination and diamond subjected to oxygen termination in an $F_2$ atmosphere.

In an electrolytic cell using the electrode, it is possible to synthesize fluorine-containing substances stably under the high current density. The fluorine-containing substances which can be synthesized are $F_2$, $NF_3$, and the like. $F_2$ is obtained by using the KF-2HF-based molten salt, $NF_3$ is obtained by using the $NH_4F$—HF-based molten salt, and a mixture of $F_2$ and $NF_3$ is obtained by using the $NH_4F$—KF—HF molten salt.

Also, it is possible to obtain the fluorine-containing substances without operations such as dehydration electrolysis and removal of sludge, and it is possible to control an amount of each of the fluorine-containing substances easily by changing a load current density.

As a synthesis method of an organic fluorine compound by using nickel for an anode in a mixed molten salt bath which is an electrolytic bath containing a fluoride ion, Tasaka et al. discloses a method of electrolytic synthesis of perfluorotrimethylamine $[(CF_3)_3N]$ using $(CH_3)NF$-4.0HF molten salt as an electrolytic bath in Reference 8, and points out that, though the life of the nickel anode achieved by this method is short, the life of the nickel anode is improved by adding CsF-2.0HF to the electrolytic bath.

In contrast, the electrode according to this invention, which has a substrate comprising the carbonaceous material and is coated with the electroconductive carbonaceous film having the diamond structure, enables to continue the synthesis of $(CF_3)_3N$ without the addition of CsF-2.0HF to the electrolytic bath.

This invention provides an electrolytic electrode comprising: an electroconductive substrate at least having a surface comprising an electroconductive carbonaceous material; and an electroconductive carbonaceous film having a diamond structure the electroconductive carbonaceous film coating at least a part of the electroconductive carbonaceous substrate as an anode in synthesizing a fluorine-containing substance by electrolysis, which enables suppression of anode effect and electrode dissolution, and an electrolytic cell using the electrode enables stable synthesis of a fluorine compound at a high current density. Thus, electrolytic bath management in electrolytic synthesis of the fluorine-containing substance is facilitated and frequencies of electrode renewal and electrolytic bath renewal are reduced to improve productivity of the synthesis of the fluorine-containing substance.

Further details of an electrode for synthesis of a fluorine-containing substance of the invention will be described below.

The electrode according to this invention is manufactured by coating an electroconductive carbonaceous film having a diamond structure (hereinafter referred to as electroconductive carbonaceous film) on an electroconductive substrate of which at least a surface is made from a carbonaceous material (hereinafter referred to as substrate). Examples of the electroconductive carbonaceous film having the diamond structure include electroconductive diamond and electroconductive diamond-like carbon as described above, and the electroconductive diamond is particularly preferred.

A shape of the substrate is not particularly limited, and a substrate which is in the form of a plate, a mesh, a stick, a pipe, a sphere such as beads, or a porous plate is usable.

When the substrate is perfectly coated with the electroconductive carbonaceous film having the diamond structure, a material for the substrate is not particularly limited insofar as the material is electroconductive. Examples of the material include a non-metallic material such as silicon, silicon carbide, graphite, non-crystalline carbon and a metallic material such as titanium, niobium, zirconium, tantalum, molybdenum, tungsten, and nickel. When a material poor in chemical stability against the fluoride ion is used in the case where a part of the substrate is exposed, the electrode can be decayed due to the exposed part to result in discontinuation of the electrolysis.

In the formation of the electroconductive carbonaceous film on the substrate, in the case of using an electroconductive diamond film as the electroconductive carbonaceous film, it is difficult to coat the substrate perfectly without a slightest defect since the electroconductive diamond film is in fact polycrystalline. Then, a carbonaceous material which is self-stabilized by forming $(CF)_n$ or electroconductive diamond which is chemically stable is usable as the substrate. Also, it is possible to use as the substrate a metal material such as nickel and stainless by coating the metal material with a remarkably dense carbonaceous substance such as diamond-like carbon and amorphous carbon.

A method of coating the electroconductive carbonaceous substance having the diamond structure on the substrate is not particularly limited, and it is possible to employ an arbitrary method. Examples of representative production method are thermal filament CVD (chemical vapor deposition), microwave plasma CVD, plasma arc jet, and physical vapor deposition, and the like.

In the case of forming an electroconductive carbonaceous film including the electroconductive diamond, a mixture gas of a hydrogen gas and a carbon source is used as a diamond raw material in any methods, and a small amount of an element (hereinafter referred to as a dopant) different in atomic value is added for imparting electroconductivity to the diamond. It is preferable to use boron, phosphorous, or nitride as the dopant, and a content of the dopant is preferably 1 to 100,000 ppm, more preferably from 100 to 10,000 ppm. In any of the methods, the synthesized electroconductive diamond included in the electroconductive carbonaceous film is polycrystalline, and an amorphous carbon and a graphite ingredient remain in the electroconductive diamond.

From the viewpoint of stability of the electroconductive carbonaceous film including electroconductive diamond, it is preferable to minimize amounts of the amorphous carbon and the graphite ingredient, and it is preferable that a ratio I(D)/I(G) between peak intensity I(D) existing near 1,332 $cm^{-1}$ (range of 1,312 to 1,352 $cm^{-1}$) belonging to diamond and peak intensity I(G) near 1,580 $cm^{-1}$ (range of 1,560 to 1,600 $cm^{-1}$) belonging to a G band of graphite in the Raman spectroscopic analysis is 1 or more. Namely, it is preferable that content of diamond is larger than a content of graphite.

Furthermore, in the invention, it is preferable that coating ratio of the electroconductive carbonaceous film to the electroconductive substrate is 10% or more.

The thermal filament CVD which is a representative method for forming a electroconductive carbonaceous film on a substrate will be described.

An organic compound used as the carbon source, such as methane, alcohol, and acetone, and the dopant are supplied to a filament together with a hydrogen gas and the like. The filament is then heated to a temperature of from 1,800° C. to 2,800° C. at which a hydrogen radical and the like are generated and an electroconductive substrate is disposed in the atmosphere of the filament so that a temperature range for precipitating diamond (750° C. to 950° C.) is achieved.

A feed rate of the mixture gas depends on the size of a reaction cell, and a pressure may preferably be from 15 to 760 Torr.

The surface of the electroconductive substrate may preferably be polished for the purpose of improving adhesion of the substrate to the electroconductive carbonaceous film. The surface of the substrate preferably has a calculated mean roughness Ra of from 0.1 to 15 μm and/or a maximum height Rz of from 1 to 100 μm. In the case of forming an electroconductive carbonaceous film including the electroconductive diamond, nucleation of diamond powder on the substrate surface is effective for growing a uniform diamond layer. A diamond fine particle layer having a particle diameter of from 0.001 to 2 μm is ordinarily precipitated on the substrate. It is possible to adjust a thickness of the electroconductive carbonaceous film by changing a vapor deposition time period, and the thickness may preferably be from 1 to 10 μm from the viewpoint of cost.

With the use of the electrode of the invention as the anode and the use of nickel, stainless, or the like for a cathode, it is possible to obtain $F_2$ or $NF_3$ from the anode after performing electrolysis in a KF-2HF, $NH_4F$-(1 to 3)HF, or $NH_4F$—KF—HF molten salt at a current density of from 1 to 100 $A/dm^2$. Also, it is possible to obtain another fluorine compound by changing the composition of the bath.

A soft steel, a nickel alloy, a fluorine-based resin, and the like may be used as a material of the electrolytic cell in view of a corrosion resistance against high temperature hydrogen fluoride. In order to prevent mixing of $F_2$ or the fluorine compound synthesized at the anode with the hydrogen gas generated at the cathode, it is preferable that an anode part and a cathode part are partitioned from each other perfectly or partly with the use of a barrier wall, a barrier membrane, or the like.

The KF-2HF molten salt used as the electrolytic bath is prepared by injecting an anhydrous hydrogen fluoride gas to acidic potassium fluoride. The $NH_4F$-(1 to 3)HF molten salt used as the electrolytic bath is prepared by injecting the anhydrous hydrogen fluoride gas to ammonium monohydrogen diifluoride and/or ammonium fluoride. The $NH_4F$—KF—HF molten salt used as the electrolytic bath is prepared by injecting the anhydrous hydrogen fluoride gas to acidic potassium fluoride, ammonium monohydrogen diifluoride and/or ammonium fluoride.

Since water is mixed in the electrolytic bath immediately after the preparation on the order of a several hundreds of ppm, it is necessary to perform water removal by dehydration electrolysis at a low current density of from 0.1 to 1 $A/dm^2$ for the purpose of suppressing the anode effect in an electrolytic cell using the existent carbon electrode as the anode. However, in the electrolytic cell using the electrode of this invention, it is possible to perform the dehydration electrolysis at a high current density to complete the dehydration electrolysis in a short time. Also, it is possible to start operation at a predetermined current density without the dehydration electrolysis.

A trace of HF accompanying $F_2$ or the fluorine compound generated at the anode is removed by a removing process such as passing $F_2$ or the fluorine compound through a column filled with granular sodium fluoride. Also, traces of nitride, oxygen, and dinitrogen monoxide are generated in the case of the $NF_3$ synthesis. Dinitrogen monoxide is removed by a removing process such as passing through water and sodium thiosulfate. Oxygen is removed by a removing process such as using an active carbon. With such method, the traces of gases accompanying $F_2$ or $NF_3$ are removed, so that high purity $F_2$ or $NF_3$ are synthesized.

In the present invention, since the electrolysis is free from the electrode dissolution and the generation of sludge, a frequency of discontinuation of the electrolysis due to electrode renewal and electrolytic bath renewal is reduced. It is possible to perform a long term and stable synthesis of $F_2$ or $NF_3$ insofar as HF or HF and $NH_4F$, which are consumed by the electrolysis, is supplemented.

EXAMPLES

Examples and Comparative Examples of a production of the electrolytic electrode according to this invention are now illustrated, but it should be understood that the present invention is not to be construed as being limited thereto.

Example 1

An electrode was prepared by using a graphite plate as the electroconductive substrate and a thermal filament CVD apparatus under the following conditions.

Both sides of the substrate were polished by using a polisher formed of diamond particles having a particle diameter of 1 μm. A calculated mean roughness Ra of the surfaces of the substrate was 0.2 μm, and a maximum height Rz of the substrate was 6 μm. Next, diamond particles having a particle diameter of 4 nm were nucleated on whole surfaces of the substrate, and then the substrate was placed in the thermal filament CVD apparatus. A mixture gas obtained by adding 1 vol % of a methane gas and 0.5 ppm of a trimethylboron gas to a hydrogen gas was supplied to the apparatus at a feed rate of 5 L/min, a pressure inside the apparatus was maintained at 75 Torr, and electric power was applied to the filament to raise a temperature to 2,400° C. Under such conditions, a temperature of the substrate was 860° C. The CVD operation was continued for 8 hours. The same CVD operation was repeated to coat the whole surfaces of the substrate with electroconductive diamond. Precipitation of diamond was confirmed by the Raman spectroscopic analysis and the X-ray diffraction analysis, and a ratio of peak intensity of 1332 $cm^{-1}$ to peak intensity of 1580 $cm^{-1}$ in the Raman spectroscopic analysis was 1:0.4

An electrode prepared by the same operation was dismantled and subjected to a SEM observation to detect that a thickness thereof was 4 μm.

The electrode which was not dismantled was used as an anode in a KF-2HF-based molten salt immediately after preparing the bath, and constant current electrolysis was performed by using a nickel plate as a cathode at a current density of 20 $A/dm^2$. A cell voltage after 24 hours from the start of the electrolysis was 5.6 V. The electrolysis was continued further, and a cell voltage after passing further 24 hours from then was 5.6 V. A gas generated by the anode at that time was analyzed. The generated gas was $F_2$, and a generation efficiency was 98%.

Example 2

After the electrolysis of Example 1, the electrolysis was continued under the same conditions except for changing the current density from 20 to 100 $A/dm^2$. A cell voltage after 24 hours from the increase in current density to 100 $A/dm^2$ was 8.0 V, and a gas generated by the anode when 24 hours had passed was analyzed. The generated gas was $F_2$, and a generation efficiency was 98%.

The electrolysis was further continued for 3,000 hours under the same conditions, and it was confirmed that the cell voltage was not increased. After that, the electrolysis was discontinued, and the electrode was cleaned by using anhydrous hydrogen fluoride, followed by sufficient drying. After the drying, a weight of the electrode was measured. The measured weight was 98.8% which was the same as the weight before the electrolysis, and no remarkable dissolution of the electrode was observed. Also, no sludge was observed by a visual observation of the electrolytic bath performed immediately after the discontinuation of the electrolysis.

Example 3

An electrode was prepared in the same manner as in Example 1 except for coating one side of the substrate with an electroconductive polycrystalline diamond. A surface energy calculated from a contact angle of water on the side coated with the electroconductive polycrystalline diamond with methylene iodide was 40.1 dyn/cm, and a surface energy of a graphite side which was not coated with diamond was 41.5 dyn/cm. Electrolysis was performed in a KF-2HF molten salt immediately after preparing the bath under the conditions same as those of Example 1 except for using the electrode of this example, and a cell voltage after 24 hours from the start of the electrolysis was 5.5 V. The electrolysis was continued further, and a cell voltage after passing further 24 hours from the start of the electrolysis was 5:5 V. A gas generated by the anode at that time was analyzed. The generated gas was $F_2$, and a generation efficiency was 98%. The electrolysis was continued further for 24 hours at a current density of 100 $A/dm^2$ to discontinue the electrolysis. The electrode was taken out to be cleaned by using anhydrous hydrogen fluoride, and calculation of surface energy was performed in the same manner as that performed before the electrolysis. The surface energy on the side coated with the electroconductive diamond was 38.0 dyn/cm, and the surface energy of the graphite side which was not coated with diamond was 3.5 dyn/cm. Thus, it was confirmed that the electroconductive diamond layer is stable, and the graphite was stabilized by $(CF)_n$ which is lower in surface energy.

Example 4

The electrode prepared in the same manner as in Example 1 was used as an anode in an $NH_4F$-2HF molten salt immediately after preparing the bath, and constant current electrolysis was performed by using a nickel plate as a cathode at a current density of 20 $A/dm^2$. A cell voltage after 24 hours from the start of the electrolysis was 5.8 V. A gas generated by the anode at that time was analyzed. The generated gas was $NF_3$, and a generation efficiency was 63%.

Comparative Example 1

Electrolysis was performed in a KF-2HF molten salt immediately after preparing the bath under the conditions same as those of Example 1 except for using a graphite plate as an anode. A violent raise in cell voltage occurred immediately after the start of the electrolysis, so that it was impossible to continue the electrolysis. That is, the anode effect occurred.

Comparative Example 2

Electrolysis was performed for 150 hours under the conditions same as those of Comparative Example 1 except for changing the electrolysis current density to 1 $A/dm^2$. Then, the current density was increased to 20 $A/dm^2$. A cell voltage after 24 hours from the increase in current density was 6.5 V. A gas generated by the anode when 24 hours had passed was analyzed. The generated gas was $F_2$, and a generation efficiency was 98%. After that, when the current density was increased to about 60 $A/dm^2$, the cell voltage was raised violently, so that it was impossible to continue the electrolysis. That is, the anode effect occurred.

Comparative Example 3

An electrode was prepared under the conditions same as those of Example 1 except for using a p-type silicon plate in place of the graphite plate as the electroconductive substrate. A calculated mean roughness Ra of surfaces of the substrate was 0.2 μm, and a maximum height Rz of the substrate was 2.1 μm. Whole surfaces of the thus-prepared electroconductive diamond were observed by the use of a 40-power optical microscope, and a part which is not coated with the electroconductive diamond, such as a pinhole, was not observed.

Electrolysis was performed in a KF-2HF molten salt immediately after preparing the bath under the conditions same as those of Example 1 except for using the electrode of this comparative example, a voltage started to raise when 20 hours had passed from the start of the electrolysis, so that it was impossible to continue the electrolysis. The electrode was observed after the discontinuance of the electrolysis, and it was found that the diamond layer of the part immersed in the electrolytic bath was almost stripped off.

Comparative Example 4

An electrode was prepared under the conditions same as those of Example 1 except for using a niobium plate in place of the graphite plate as the electroconductive substrate. A calculated mean roughness Ra of surfaces of the substrate was 3 μm, and a maximum height Rz of the substrate was 18 μm. Whole surfaces of the thus-prepared electroconductive diamond were observed by the use of a 40-power optical microscope, and a part which is not coated with the electroconductive diamond, such as a pinhole, was not observed. Electrolysis was performed in a KF-2HF molten salt immediately after preparing the bath under the conditions same as those of Example 1 except for using the electrode of this comparative example, and a voltage started to raise when 3 hours had passed from the start of the electrolysis, so that it was impossible to continue the electrolysis. The electrode was observed alter the discontinuance of the electrolysis, and it was found that the diamond layer of the part immersed in the electrolytic bath was almost stripped off.

It is considered that, in Comparative examples 3 and 4 the electrolytic solution invaded the electrode from a pinhole which was not detected by the 40-power optical microscope or a particle boundary of the diamond crystal to cause corrosion of the substrate from the invasion part resulting in the strip off of the electroconductive diamond layer.

While the present invention has been described in detail and with reference to specific embodiments thereof, it will be apparent to one skilled in the art that various changes and modifications can be made therein without departing from the spirit and scope thereof.

The present application is based on Japanese Patent Application No. 2005-71489 filed on Mar. 14, 2005, and the contents thereof are incorporated herein by reference.

What is claimed is:

1. An electrolytic anode for use in electrolytically synthesizing a fluorine-containing substance by using an electrolytic bath containing a fluoride ion comprising:

an electroconductive substrate having a surface including an electroconductive carbonaceous material; and an electroconductive carbonaceous film having a diamond structure, the electroconductive carbonaceous film coating a part of the electroconductive carbonaceous substrate, wherein the electroconductive carbonaceous film has a ratio I(D)/I(G) of 1 or more, wherein I(D) represents a peak intensity existing in the range of 1312 to 1352 $cm^{-1}$ belonging to diamond and I(G) represents a peak intensity existing in the range of 1560 to 1600 $cm^{-1}$ belonging to G band of graphite, in a Raman spectroscopic analysis.

2. The electrolytic anode according to claim 1, wherein the electroconductive carbonaceous material is at least one material selected from the group consisting of a graphite, an amorphous carbon, a diamond-like carbon, and an electroconductive diamond.

3. The electrolytic anode according to claim 1, wherein a coating ratio of the electroconductive carbonaceous film to the electroconductive substrate is 10% or more.

4. The electrolytic anode as in any of claims 1, 2 or 3, wherein the fluorine-containing substance is one of a fluorine gas or a nitrogen trifluoride.

5. A method for electrolytically synthesizing a fluorine-containing substance, comprising:

preparing an electrolytic anode comprising: an electroconductive substrate having a surface including an electroconductive carbonaceous material; and an electroconductive carbonaceous film having a diamond structure, the electroconductive carbonaceous film coating a part of the electroconductive carbonaceous substrate; and performing electrolysis by using the electrolytic anode in an electrolytic bath containing a fluoride ion to obtain a fluorine-containing substance.

6. The method for electrolytically synthesizing a fluorine-containing substance according to claim 5, wherein the fluorine-containing substance is one of a fluorine gas or a nitrogen trifluoride.

* * * * *